US009343007B2

(12) United States Patent
Chiu et al.

(10) Patent No.: US 9,343,007 B2
(45) Date of Patent: May 17, 2016

(54) SWITCH STRUCTURE AND METHOD OF CHARGING AND DISCHARING SCAN LINES OF AN LED DISPLAY

(71) Applicants: Han-Hui Chiu, Taichung (TW); Kuo-Lun Huang, Hsinchu (TW)

(72) Inventors: Han-Hui Chiu, Taichung (TW); Kuo-Lun Huang, Hsinchu (TW)

(73) Assignee: MY-SEMI INC., Hsinchu County (TW)

( * ) Notice: Subject to any disclaimer, the term of this patent is extended or adjusted under 35 U.S.C. 154(b) by 56 days.

(21) Appl. No.: 14/281,921

(22) Filed: May 20, 2014

(65) Prior Publication Data

US 2014/0347255 A1 Nov. 27, 2014

Related U.S. Application Data

(60) Provisional application No. 61/825,544, filed on May 21, 2013.

(51) Int. Cl.
*G09G 3/32* (2016.01)

(52) U.S. Cl.
CPC ..... *G09G 3/32* (2013.01); *G09G 2300/06* (2013.01); *G09G 2310/0275* (2013.01); *G09G 2320/0209* (2013.01)

(58) Field of Classification Search
CPC ..... G09G 2300/06; G09G 2310/0275; G09G 2320/0209
See application file for complete search history.

(56) References Cited

U.S. PATENT DOCUMENTS 6,894,685 B2 * 5/2005 Ogusu ..... G09G 3/3216 315/169.1
2013/0234626 A1 * 9/2013 Li ..... H05B 37/02 315/360

* cited by examiner

*Primary Examiner* — Latanya Bibbins
(74) *Attorney, Agent, or Firm* — Min-Lee Teng; Litron Patent & Trademark Office

(57) ABSTRACT

A method to eliminate caterpillar phenomenon in a scanning LED display is disclosed, wherein each scan line comprises a USW(N) for charging the scan line(N) and a DSW(N) for discharging the scan line(N), the method comprising: turning on the USW(N) to charge the scan line(N) for a first time interval; turning on the DSW(N) to discharge the scan line(N) for a second pre-determined time interval; and turning off the DSW(N) after the second pre-determined time interval is elapsed.

18 Claims, 15 Drawing Sheets

SWITCH STRUCTURE AND METHOD OF CHARGING AND DISCHARING SCAN LINES OF AN LED DISPLAY

BACKGROUND OF THE INVENTION

1. Field of the Invention

The present invention relates to a switch control in a scanning LED display, and more particularly, to eliminate ghost images of the scanning LED display due to the switching of the scan lines in the LED display.

2. Description of Related Art

FIG. 1 illustrates a driving circuit in a conventional LED display using scan lines. There is a switch SW(N) for controlling a corresponding scan line N, wherein one end of the SW(N) is connected to anodes of the LED(s) in the scan line (N), and another end of the SW(N) is connected to a power supply voltage, such as Vsupply+. The SW(N) is controlled by an enable signal S(N), wherein when the S(N) is enabled, the SW(N) is turned on, or closed; otherwise, SW(N) is turned off or opened.

As shown on FIG. 1, when the SW(1) is turned on and the voltage of the anodes of the LED(S) in scan line (1) will be charged to $V_{s1}$; when the SW(2) is turn on and the voltage of the anodes of the LED(S) in scan line (2) will be charged to $V_{s2}$; when the SW(2) is turn on and the voltage of the anodes of the LED(S) in scan line (3) will be charged $V_{s3}$; and when the SW(4) is turn on and the voltage of the anodes of the LED(s) in scan line(4) will be charged to $V_{s4}$. Currents I1, I2, I3 and I4 flowing through each row of the LED(s) of the scan lines can be conditioned by current sources connected to cathodes of the LED(s) of the scan lines, respectively, wherein a bias voltage is applied at cathodes of LED(s) in each row respectively. Each of the scan line will be scanned by activating the corresponding enable signal of the scan line in a pre-determined order, for example, S1→S2→S3→S4. In each scan line(N), there is a corresponding parasitic capacitance $C_{p1}$, $C_{p2}$, $C_{p3}$, $C_{p4}$, coupled from the anodes of the LED(s) of the scan lines to the ground voltage, respectively, as shown in FIG. 1.

FIG. 2A shows a 4×4 LED display using scan lines. Assume that there is an image in which the diagonal LED(s), $D_{11}$, $D_{22}$, $D_{33}$ and $D_{44}$, are conditioned to emit light, and other LED(s) are conditioned to be turned off and remains dark. However, in addition to the diagonal LED(s), $D_{11}$, $D_{22}$, $D_{33}$ and $D_{44}$ that are configured to be turned on in the image, some other LED(s) that are supposed to remain dark are actually turned on for a short time period and emit light briefly, which is not supposed to happen in the original image. When the scan line is switched from scan line 1 to scan line 2, that is, when S1 goes low to turn off the SW(1) and S2 goes high to turn on the SW(2), the charge stored in the parasitic capacitance $C_{p1}$ has no conductive path to discharge when the SW(1) is turned off; therefore, the voltage at anodes of the LED(s) of the scan line 1 will be kept at voltage $V_{S1}$. Because $D_{22}$ is turned on, the current I2 will be conducted by pulling the voltage at the cathode of the $D_{22}$ to a low voltage level to allow the $D_{22}$ to emit light. Since the cathodes of the $D_{12}$ and $D_{22}$ are connected together, $D_{12}$ will be turned on due to the fact that the anode voltage of the $D_{12}$ is kept at the voltage $V_{S1}$ by the parasitic capacitance $C_{p1}$. At this time, the voltage $V_{S1}$ will be discharged quickly through the $D_{12}$ as well. As a result, the $D_{12}$ will be turned on only for a very short time period and therefore generates visual effects, which can be evidenced by a glitch occurred to the signal $ID_{12}$ in FIG. 2B. Such visual effects will be contributed by the LED(s) $D_{23}$, $D_{34}$, and $D_{41}$ as well, which can be evidenced by a glitch in each of the signal $ID_{23}$, $ID_{34}$, and $ID_{41}$ in FIG. 2B.

SUMMARY OF THE INVENTION

Accordingly, the present invention is directed to a switch structure and a method to eliminate ghost images and caterpillar phenomenon in a scanning LED display.

In one embodiment, the present invention provides a method to control charging and discharging scan lines of an LED display, wherein each scan line(N) comprises a corresponding USW(N) for charging the scan line(N) and a corresponding DSW(N) for discharging the scan line(N), the method comprising: turning on the USW(N) to charge the scan line(N) for a first time interval; turning on the DSW(N) to discharge the scan line(N) for a second pre-determined time interval; and turning off the DSW(N) after the second pre-determined time interval is elapsed.

In one embodiment, the second pre-determined time interval is shorter than the first time interval.

In one embodiment, the method further comprises turning on USW(N+1) to charge the scan line(N+1) for a third time interval, wherein the third time interval is overlapped with the second pre-determined time interval.

In one embodiment, the method further comprises turning on USW(N+1) to charge the scan line(N+1) for a third time interval, wherein the third time interval is not overlapped with the second pre-determined time interval.

In one embodiment, the present invention provides a method to eliminate caterpillar phenomenon in a scanning LED display, wherein each scan line of the LED display comprises a corresponding switch SW(N) for controlling the scan line(N), wherein each switch SW(N) comprises a USW (N) for charging the scan line(N) and a DSW(N) for discharging the scan line(N), the method comprising: turning on USW (N) to charge the scan line(N) for a first time interval; turning on DSW(N) to discharge the scan line(N) for a second time interval; turning on USW(N+1) to charge the scan line(N+1) for a third time interval, wherein the first time interval, the second time interval and the third time interval are not overlapped in time.

In one embodiment, the DSW(N) is electrically connected to a first reference voltage other than a ground voltage for discharging the scan line(N) to the first reference voltage.

In one embodiment, the USW(N) and the DSW(N) are both controlled by an external control signal, further comprising a control unit for controlling the DSW(N) to output an internal control signal to control the on/off time interval of the DSW (N) according to the external control signal and a external timing signal.

In one embodiment, the USW(N) and the DSW(N) are both controlled by an external control signal, further comprising a control unit for controlling the DSW(N) to output an internal control signal to control the on/off time interval of the DSW (N) according to the external control signal and internally built timing information.

In one embodiment, the SW(N) generates control signals to control DSW(N) and USW(N) by using the external control signal S(N) and the DSW(N) control unit.

In one embodiment, the present invention provides a switch structure in an LED display having a plurality of scan lines, wherein each scan line(N) comprises a corresponding USW(N) connected to a first reference voltage for charging the scan line(N) and a corresponding DSW(N) connected to a second reference voltage for discharging the scan line(N), respectively, and cathodes of LED(s) in each row of the LED display are biased at a third reference voltage, wherein a first voltage difference between the first reference voltage and the second reference voltage and a second voltage difference between the second reference voltage and the third reference voltage are respectively less than a forward voltage of each LED in the scan lines, wherein each USW(N) is respectively on when a corresponding US(N) signal is active; and each DSW(N) is respectively on when a corresponding DS(N) signal is active, wherein each of the DS(N) signals is active for a pre-determined time interval to discharge the scan line (N).

In one embodiment, the present invention provides a method to eliminate caterpillar phenomenon in a scanning LED display, wherein each scan line of the LED display comprises a corresponding switch SW(N) for controlling the scan line(N), wherein each switch SW(N) comprises a USW (N) for charging the scan line(N) and a DSW(N) for discharging the scan line(N), the method comprising: turning on USW (N) to charge the scan line(N) for a first time interval; turning on DSW(N) to discharge the scan line(N) for a second time interval; wherein the first time interval and the second time interval are not overlapped in time.

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE EMBODIMENTS

Figure 3A:
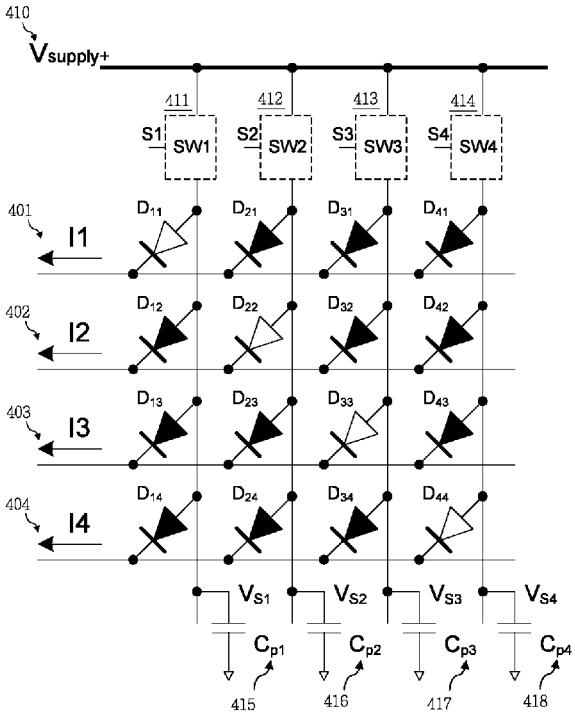
FIG. 3A-3B shows a switch structure having USW connected to a power supply and DSW connected to a ground.
Figure 3B:
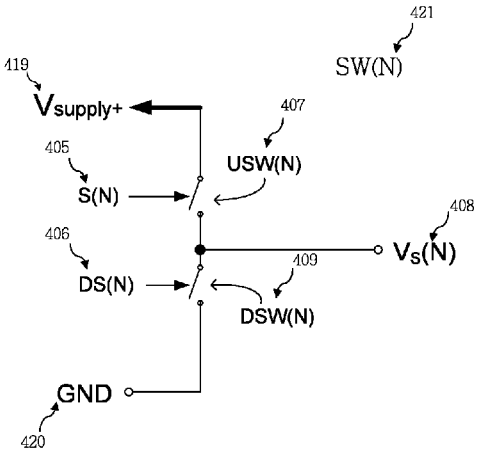

FIG. 3A shows a switch structure to resolve the ghost issue by adding a switch DSW(N) 409 connected to the ground in addition to the original SW(N) 421, which will be called USW(N) 407 hereafter, connected to the Vsupply+ as shown in FIG. 3B. Please note that USW(N) 407 corresponds to the upper switch for charging the scan line N to a power supply voltage, and DSW(N) 409 corresponds to the down switch for discharging the scan line N to a ground voltage or a lower voltage so that the voltage difference across an LED in the scan line is lower than the forward voltage of the LED. Likewise, USW(N+1) and DSW(N+1) correspond to the scan line that will be scanned immediately following the scan line N; and USW(N−1) and DSW(N−1) correspond to the scan line that has been scanned just before the scan line N. The scan sequence can be defined according to design needs, and it is not necessary to follow the physical arrangement of the scan lines. Please also note that any signal can be an active high signal or an active low signal depending on the type of the switch, although we use active high in this specification.

Figure 1:
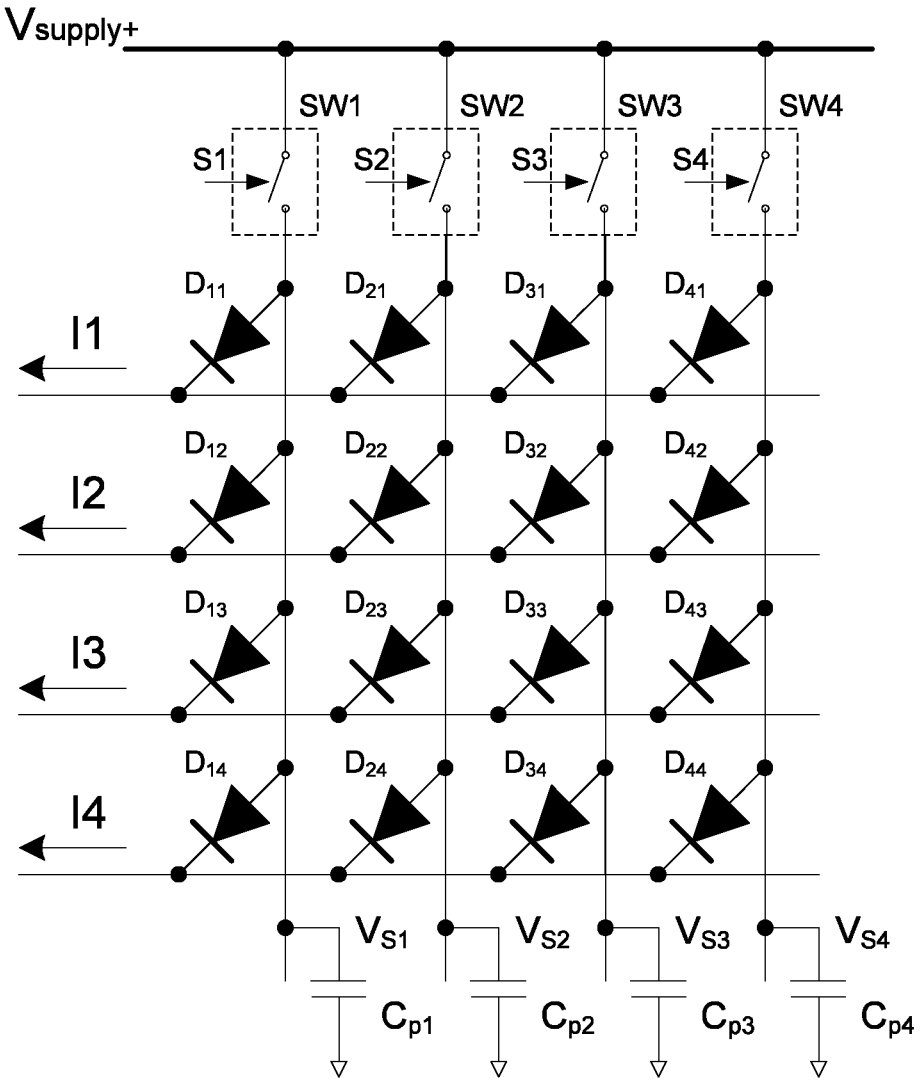
FIG. 1(Prior Art)
FIG. 1 illustrates a driving circuit in a conventional LED display using scan lines.
Figure 2A:
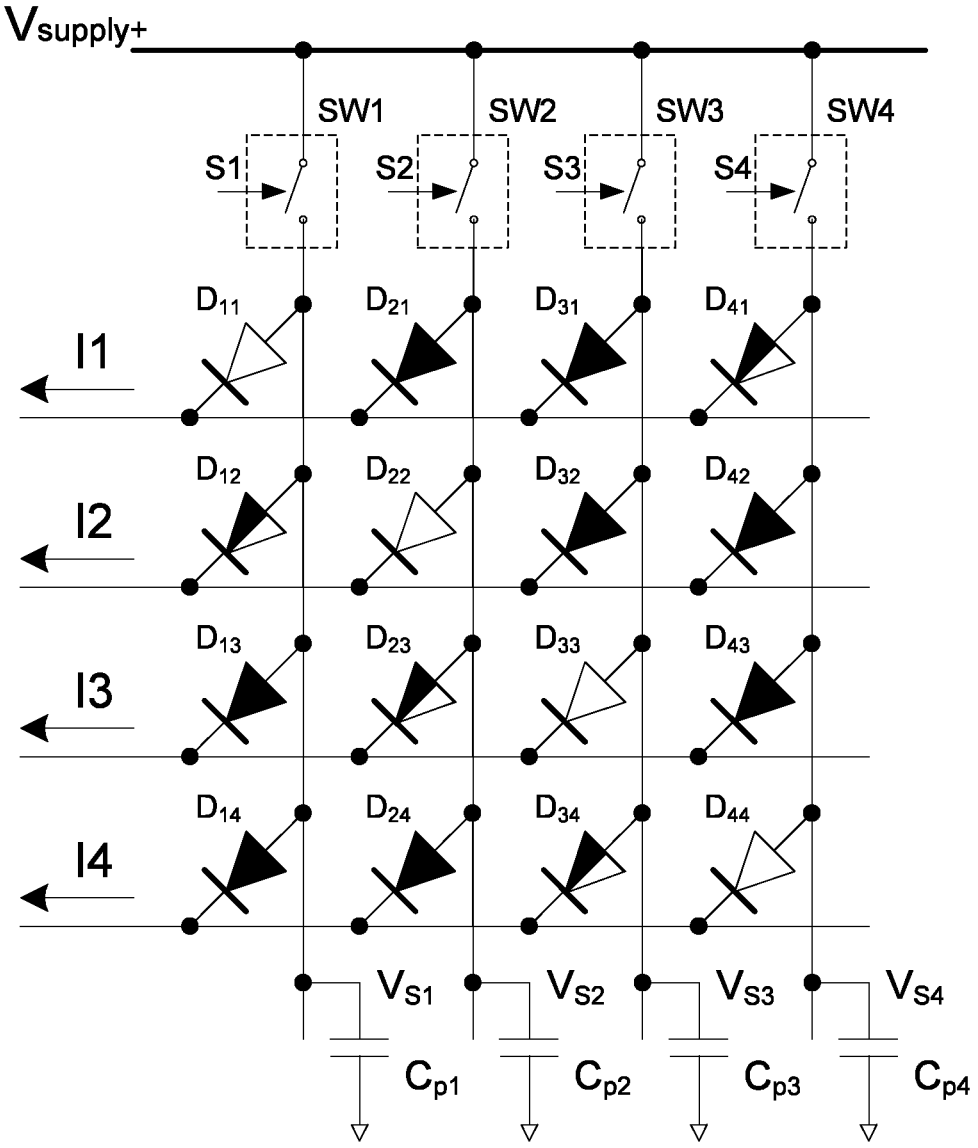
FIG. 2A(Prior Art)
FIG. 2A shows a 4×4 LED display using scan lines.
Figure 2B:
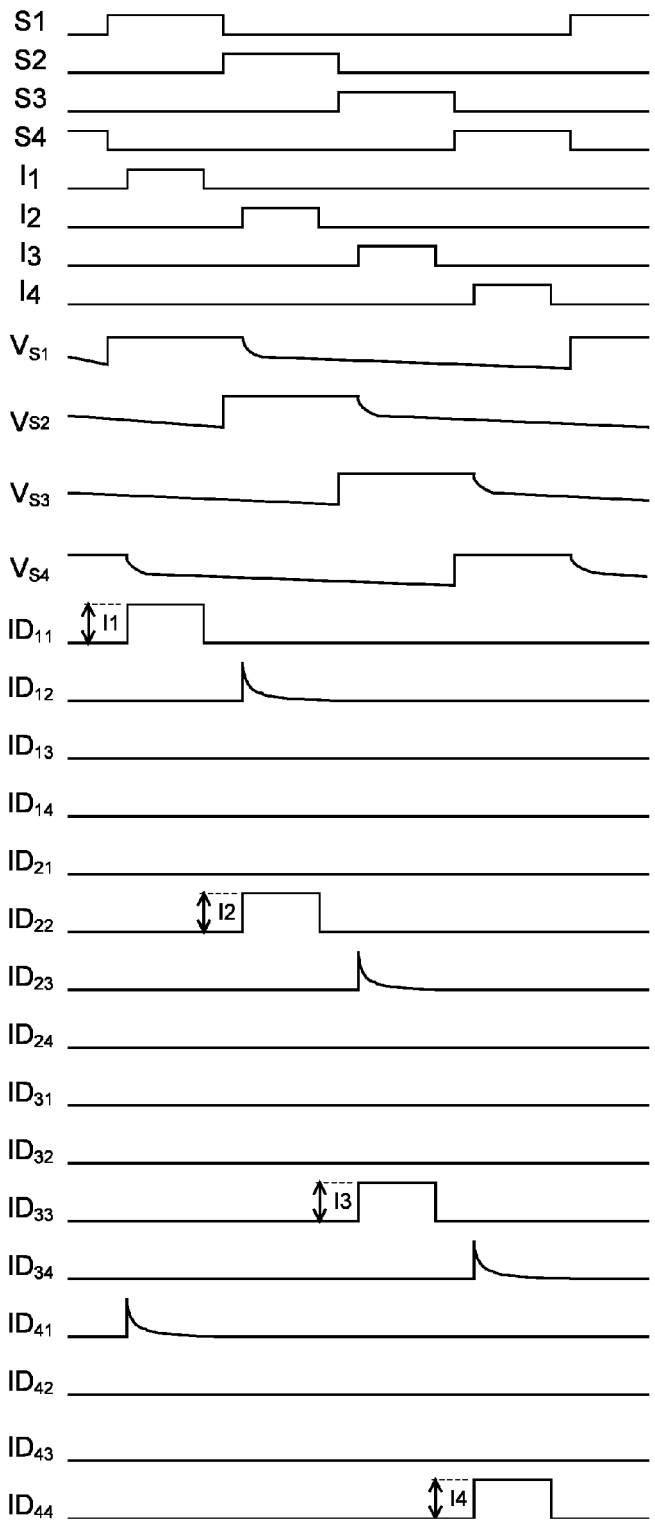
FIG.2B(Prior Art)
FIG. 2B shows a waveform of signals in the 4×4 LED display of FIG. 2A.
Figure 3C:
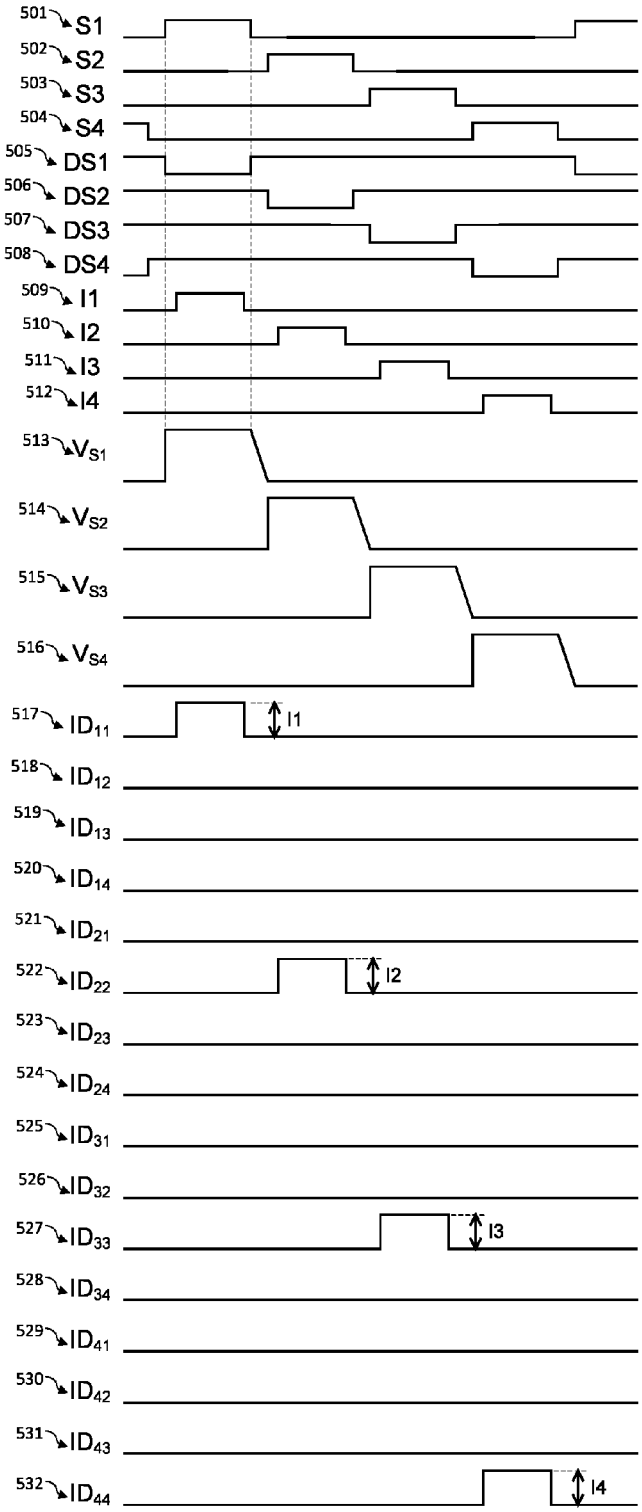
FIG. 3C shows a waveform of signals in the 4×4 LED display of FIG. 3A-3B.

When the scan line is switched from scan line 1 to scan line 2, the operation is described as follows. After turning USW(1) off, that is S1 501 is switched to a low as to discharge the $V_{S1}$ to a ground voltage GND 420. When the $V_{S1}$ is discharged to the ground voltage GND 420, the voltage difference across an LED in the scan line is lower than the forward voltage of the LED. Then, the USW(2) will be turned on to scan the next scan line, and at this time, the voltage difference across the $D_{12}$ is not enough to turn on the LED $D_{12}$, thereby preventing the ghost image due to the momentary light emitting of the LED $D_{12}$. FIG. 3C shows a timing waveform of signals in FIG. 3A-3B. As shown in FIG. 3C, there is no glitch in any of the signals, therefore, the ghost image issues occurred in FIG. 2A is resolved.

Figure 4:
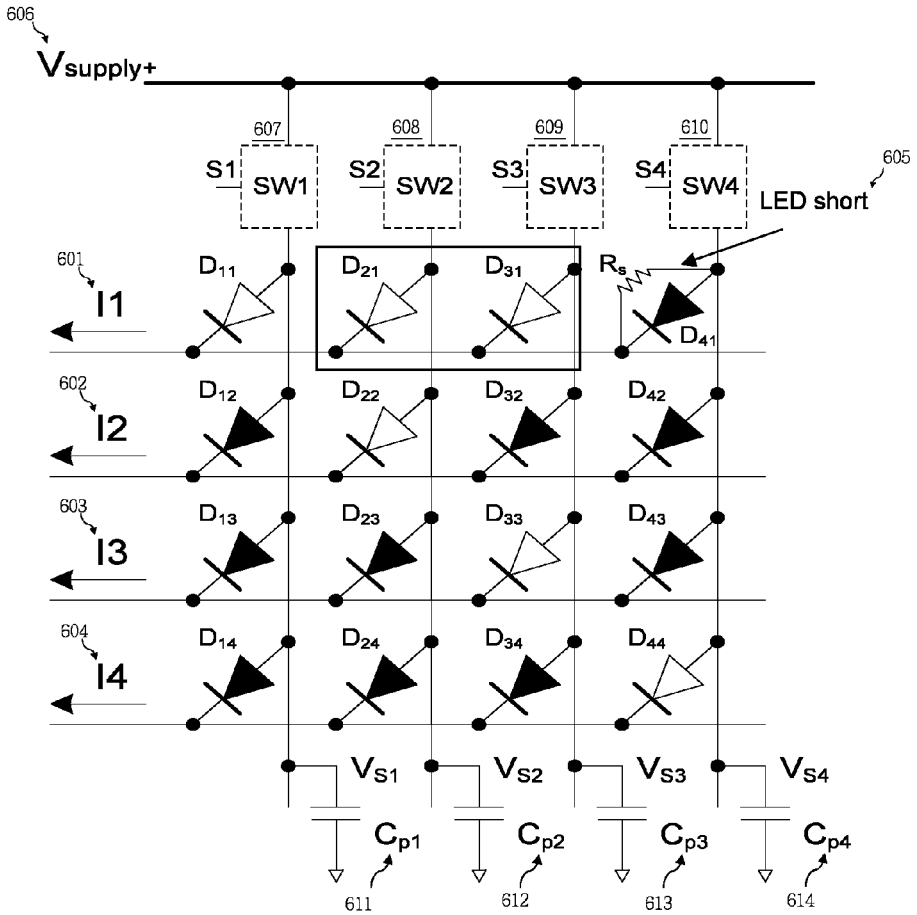
FIG. 4 illustrates the caterpillar phenomenon in the 4×4 LED display due to a short circuit in one of the LED(s).

The structure of the two separated switches, USW(N) 407 and DSW(N) 409, can resolve the ghost image issue in one aspect; however, when there is a short or leakage circuit in any of the LED(s), it will cause another visual effect called "caterpillar phenomenon." For example, as shown in FIG. 4, the LED $D_{41}$ is shorted by a resistor across the anode and cathode thereof, LED(s) $D_{21}$ and $D_{31}$, which are not supposed to be on, will be turned on. That is, the entire row of the LED(s) that contain a short circuit will be turned on, which is called caterpillar phenomenon in a scanning LED display. Please note that the "caterpillar phenomenon" can be view as another type of the "ghost image" because they are generated by some LED(s) that are not supposed to be turned on.

Figure 5:
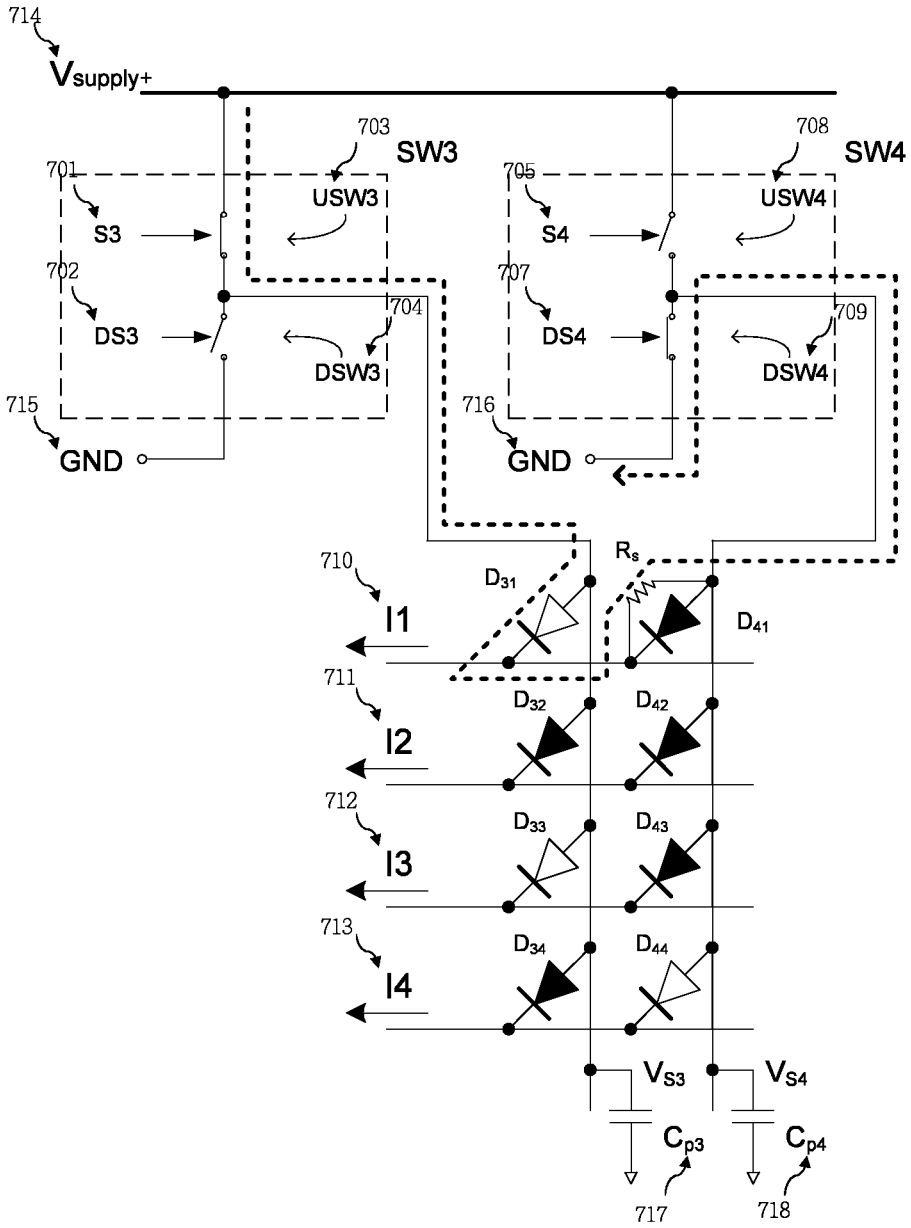
FIG. 5 illustrates the switch structure having DSW(s) connected to a ground to discharge the voltage at a scan line in accordance with an embodiment of the present invention.

The cause behind the caterpillar phenomenon is further explained as follows. As shown in FIG. 3B, for each SW(N) 421, there are two switches, USW(N) 407 and DSW(N) 409. When USW(N) 407 is turned on, DSW(N) 409 is turned off, and likewise, when the USW(N) 407 is turned off, DSW(N) 409 is turned on; that is, the enable signals S(N) 405 and DS(N) 406 are complemented to each other. Please refer to FIG. 5, when the scan line(3) is under scanned, that is, S(3) 701 is at a logic high level with DS(3) 702 at a logic low level, other USW(s) are turned off while other DSW(s) are turn on. Since the LED $D_{41}$ is shorted by a resistor Rs across the anode and cathode of the LED $D_{41}$ while both USW(3) and DSW(4) are turned on at this time, a current loop encompassing the LED $D_{31}$ is formed, and the current flows in a sequence of Vsupply+ 714→USW(3)→D31→Rs→DSW(4)→GND 716, which is shown by the dotted lines in FIG. 5. This current loop will turn on the LED $D_{31}$ to emit light. Likewise, a current loop will be formed for each other LED(s) that shares the same cathode node of the $D_{41}$ as well, because each of the LED(s) will be turned on when its corresponding USW(N) is turned on while the LED $D_{41}$ is shorted by the resistor Rs. As a result, the whole row of the LED(s) including $D_{31}$ can emit light and therefore generate the caterpillar phenomenon.

Figure 6A:
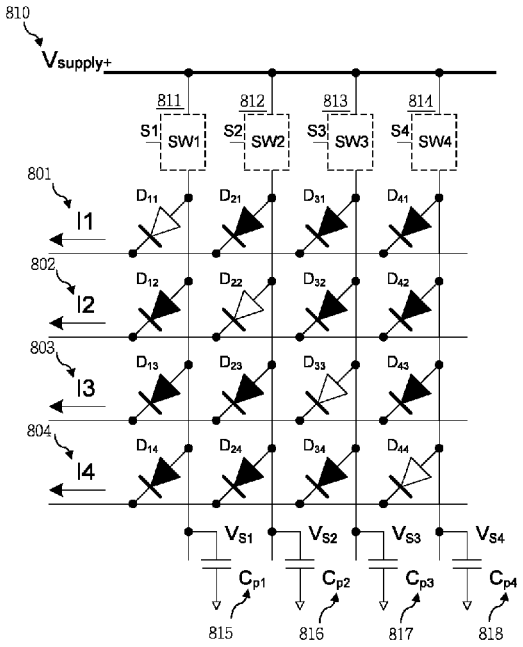
FIG. 6A-6B shows another switch structure having DSW (s) connected to a reference voltage.
Figure 6B:
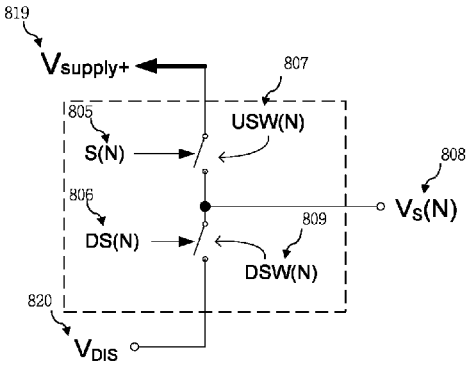

In one embodiment, a method to eliminate caterpillar phenomenon is disclosed. Please refer to FIGS. 6A and 6B. FIG. 6A is the same as the FIG. 4A; however, the switch structure is different from that of FIG. 3B. In FIG. 6B, the DSW(N) 809 is connected to a reference voltage $V_{DIS}$ 820 instead of the ground.

Based on FIG. 6B, after the USW(N) 807 is turned off by conditioning S(N) 805 to a logic low level, DSW(N) 809 is then turned on by conditioning DS(N) 806 to a logic high level so as to discharge $V_S$ (N) 808 to the voltage level $V_{DIS}$ 820 through the DSW(N) 809. As long as VS(N) 808 is discharged to a voltage level such that the voltage difference across the LED is lower than the forward voltage of the LED, the DSW(N) can be turned off. Then, USW(N+1) in the next scan line will be turned on. That is, at any given time, only one of the USW(s) and the DSW(s) is turned on, and there is no overlapping between all the enable signals of the USW(s) and DSW(s), which can be seen in FIG. 6C in which all the signals S1 901, S2 902, S3 903, and S4 904 are enable signals for USW(s) and DS1 905, DS2 906, DS3 907 and DS4 908 are enable signals for DSW(s), wherein all the signals S1 901, S2 902, S3 903, S4 904, DS1 905, DS2 906, DS3 907 and DS4 908 are not overlapped in time. By doing so, the current loop described in FIG. 4B is completely eliminated. For example, the visual effects caused by the LED $D_{12}$, shown in FIG. 2A, will not occur in this method due to the fact that the voltage difference across the $D_{12}$ will not be enough to turn on the $D_{12}$, thereby preventing the ghost image. Furthermore, caterpillar phenomenon that occurs due to the short circuit in LED $D_{41}$ will not occur by using this method, because, in this method, when any USW(N) is turned on, none of the DSW(s) will be turned on, which will eliminate the caterpillar phenomenon when there is a short circuit in the LED(s) such as LED $D_{41}$ shown in FIG. 4A. In other words, the current loop shown in FIG. 4B cannot be formed at all in this method due to the fact that when the DSW(3) is turned on, DSW(4) has been turned off already.

Figure 6C:
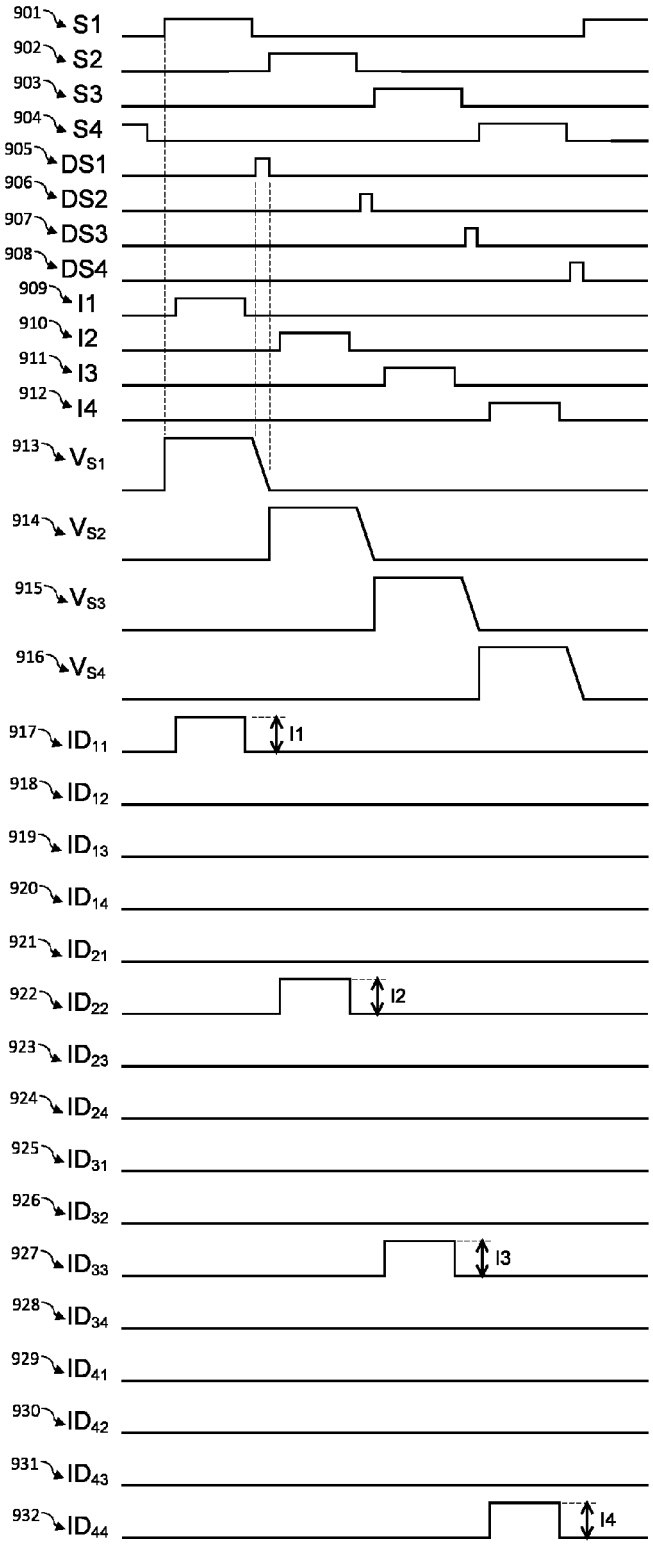
FIG. 6C shows the timing waveform of signals of the switch structure in FIG. 6A-6B.

Please note that in order to discharge the scan line to a voltage level such that the voltage difference across the LED is lower than the forward voltage of the LED, the time interval in which the DSW(N) 809 is discharging to the lower voltage level $V_{DIS}$ 820 can be controlled. When the $V_S$(N) 808 at scan line (N) is discharging, as long as the $V_S$(N) 808 is discharged to a voltage level such that the voltage difference across the anode and cathode of the LED is lower than the forward voltage of the LED, the ghost image issue can be eliminated. The timing waveform of the S(N) 805, DS(N) 806 along with other signals is shown in FIG. 6C. As shown in FIG. 6C, the DS1 905 is turned on for a short time interval to discharge $V_{S1}$ 913 to a voltage level to make the voltage difference across a LED lower than the forward voltage of the LED. By using such a method, all the enabling signals of USW(s) and DSW(s) are not overlapped, thereby eliminating the aforementioned ghost image and caterpillar phenomenon.

Figure 7A:
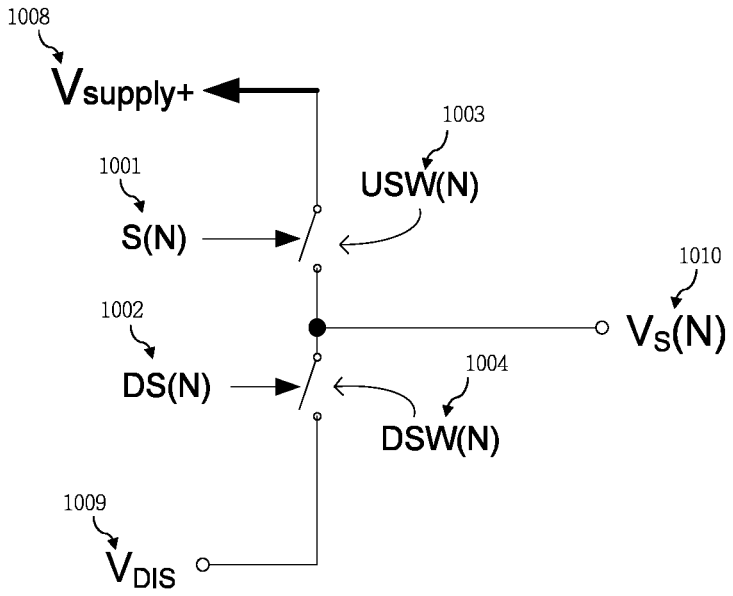
FIG. 7A-7B shows the switch structure and timing waveform of discharging the scan line based on the 4×4 LED display in FIG. 6A.
Figure 7B:
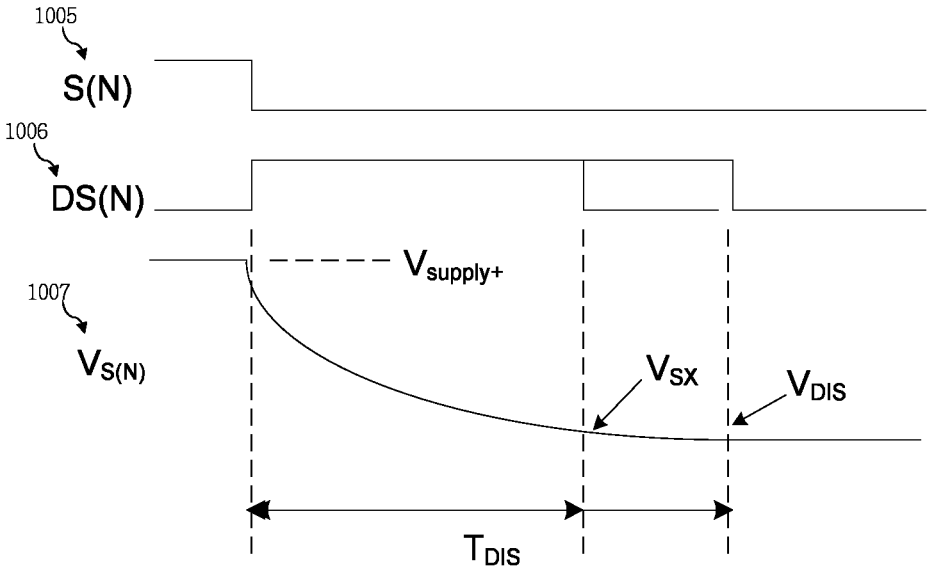

FIG. 7A-7B shows the switch structure and timing waveform of discharging the scan line based on the 4×4 LED display in FIG. 6A. In FIG. 7B, the $T_{DIS}$ is the time interval in which the DS(N) 1006 is held at a logic high level. When the DS(N) 1006 is held at a logic high level long enough, $V_S$(N) 1007 will be discharged to the voltage level $V_{DIS}$. By controlling the time interval $T_{DIS}$, $V_S$(N) 1007 voltage can be set to a voltage level $V_{SX}$ higher than the voltage level $V_{DIS}$ in order to save time. By adjusting the $T_{DIS}$ interval and the voltage level $V_{DIS}$, the $V_S$(N) 1007 can be discharged to a pre-determined voltage level that is lower than the forward voltage of the LED, and the ghost image issues and the caterpillar phenomenon can be resolved because after the $T_{DIS}$ is elapsed, the DS(N) 1006 will be held low to turn off the DSW(N) 1004. In this embodiment, the DS(N) 1006 is added to control the DSW(N) 1004 in addition to the original control signal S(N) 1005, other control circuits to eliminate the ghost image and the caterpillar phenomenon are described further as follows.

Figure 8:
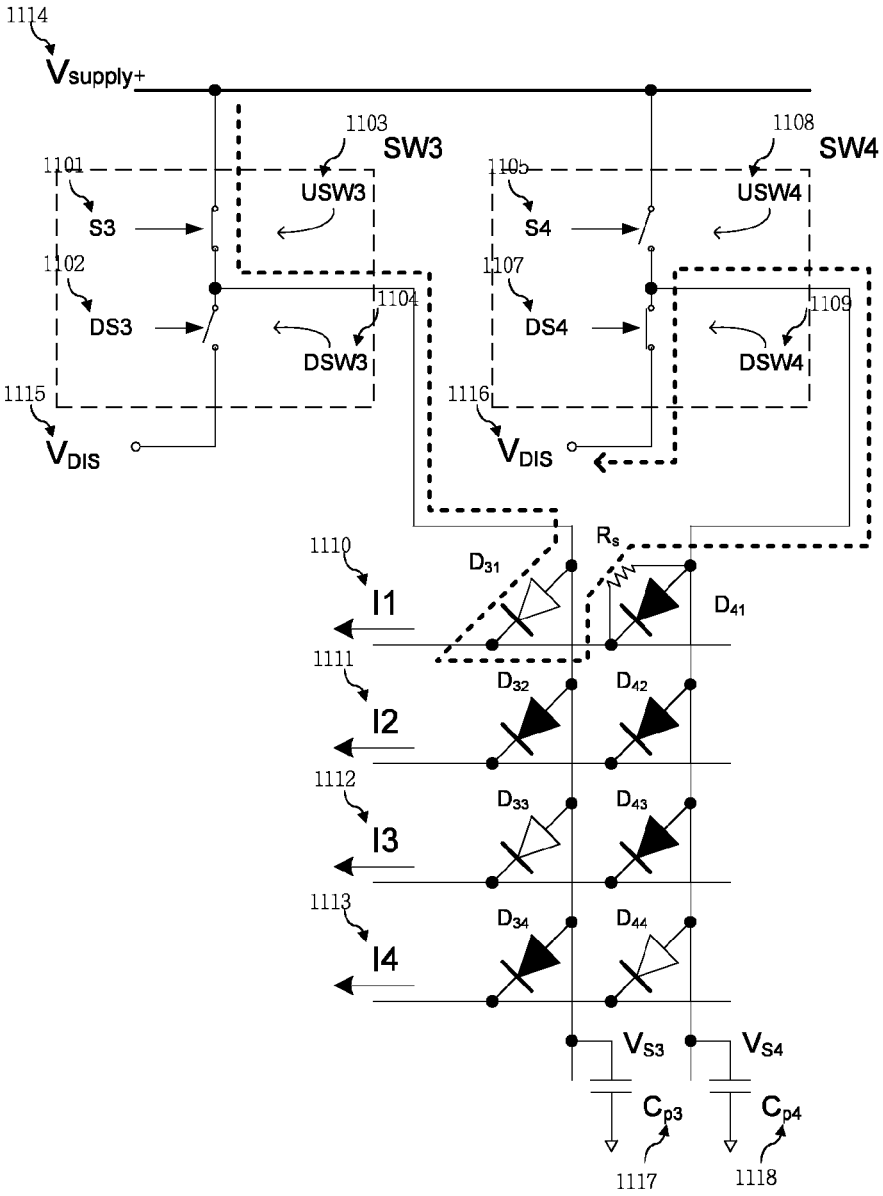
FIG. 8 illustrates another switch structure having DSW(s) connected to a reference voltage.

Please refer to FIG. 8. FIG. 8 is similar to FIG. 5, but now the DSW(4) is connected to a voltage reference $V_{DIS}$ 1116 for discharging the scan line (4) instead of the ground voltage. In order to solve the ghost and the caterpillar phenomenon, when an USW(N) is on, the corresponding DSW(N) is off; and when the USW(N) is turned off, the corresponding DSW (N) will be turned on for a time interval $T_{DIS}$ to discharge the scan line (N), and then the corresponding DSW(N) will be switched off. Assuming scan sequence is S4→S3→S2→S1, when the scan line(3) is under scanned after the scan line (4) has been just scanned, that is, S(3) 1101 is at a logic high level while DSW(4) is turned on for discharging scan line (4). Since the LED $D_{41}$ is shorted by a resistor Rs across the anode and cathode of the LED $D_{41}$ while both USW(3) and DSW(4) are turned on at this time, a current loop encompassing the LED $D_{31}$ is formed, and the current flows in a sequence of Vsupply+ 1114→USW(3) 1103→$D_{31}$→Rs→DSW(4) 1109→$V_{DIS}$ 1116, which is shown by the dotted lines in FIG. 8. Since only DSW(4) 1109 is turned on for discharging while the scan line (3) is under scanned, the current loop will turn on the LED $D_{31}$ briefly for a time interval $T_{DIS}$. Each DSW(N) will be turned on to discharge the corresponding scan line for a time interval $T_{DIS}$ and then the DSW(N) can be turned off after the time interval $T_{DIS}$ is elapsed.

In one embodiment, the time interval $T_{DIS}$ is not overlapped with the time interval in which the USW(3) 1103 is on. In one embodiment, the time interval $T_{DIS}$ is overlapped with the time interval in which the scan line (3) is on. The length of the time interval $T_{DIS}$ can be controlled and pre-determined such that the LED $D_{31}$ can be turned on for a short time period to emit light, and it will not cause the caterpillar phenomenon to happen because when DSW (4) is discharging, only USW (3) can be turned on, that is, the next scan line following the scan line (4) is scan line (3). In one embodiment, the $V_{DIS}$ is selected such that the current loop, Vsupply+ 1114→USW(3) 1103→$D_{31}$→Rs→DSW(4) 1109→$V_{DIS}$ 1116, will not turn on the LED $D_{31}$ because the voltage across the $D_{31}$ is less than the forward voltage of the $D_{31}$.

The current, $I_{short}$ ($D_{31}$) flowing through the LED $D_{31}$ can be determined by the following formula: $I_{short}$ ($D_{31}$)=(Vsupply+−Vf($D_{31}$)−$V_{DIS}$)/(Ron(USW3)+Rs+Ron(DSW4)), wherein Vf($D_{31}$) is the forward voltage of the $D_{31}$, Rs is the resistance across the LED $D_{41}$, Ron(USW3) is the turn-on resistance of the USW(3), and Ron(DSW4) is the turn-on resistance of the DSW4. Based on the above formula, by choosing a proper voltage level for $V_{DTs}$, the voltage across the LED $D_{31}$ will be less than the forward voltage of the LED $D_{31}$, and therefore no current will flow through the LED $D_{31}$. In this case, the USW(3) 1103 and DSW(4) 1109 can be active at the same time or even complemented to each other as shown in FIG. 3C. In one embodiment, $V_{DIS}$ can be determined by satisfying two conditions. The first condition is: the voltage difference between the voltage level of Vsupply+ and the voltage level of $V_{DIS}$ is less than the forward voltage of each LED in the scan lines to eliminate the caterpillar phenomenon as described above; the second condition is: the voltage difference between the voltage level of $V_{DIS}$ and the bias voltage applied at cathodes of LED(s) is less than the forward voltage of each LED in the scan lines to eliminate the ghost image issue. Accordingly, $V_{DIS}$ can be selected from a range of voltages that satisfy the above two conditions. Please note that the bias voltage applied at cathodes of LED(s) can be in many forms such as the self bias of a current source and/or in combination with another bias voltage.

Figure 9A:
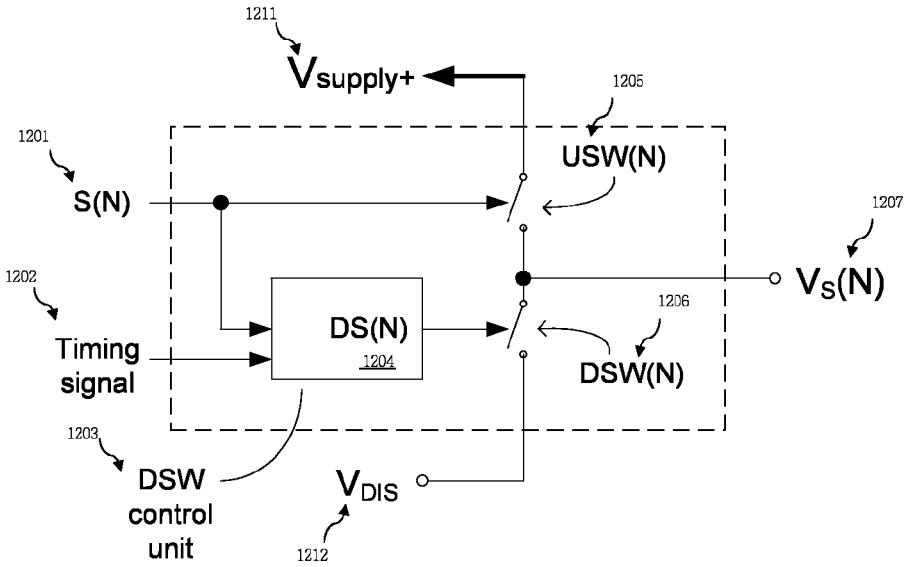
FIG. 9A-9B shows a first implementation to control the USW and DSW.
Figure 9B:
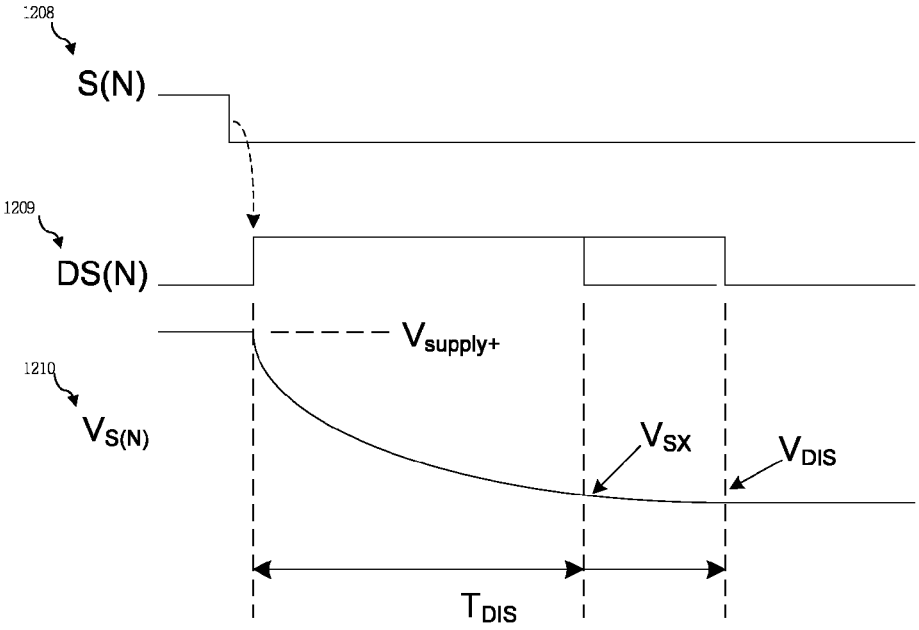

There are many ways to implement the control circuits for controlling the USW(s) and the DSW(s). In one embodiment, as shown in FIG. 9A, a DSW control unit 1203 is used for controlling the switches USW(N) 1205 and DSW(N) 1206 in the scanning LED display. The DSW control unit 1203 takes S(N) 1201 as an input and outputs DS(N) 1204 while the USW(N) 1205 is directly controlled by the S(N) 1201. The DSW control unit 1203 can have an internal timing control circuit to set the time interval of the $T_{DIS}$ to allow $V_S$(N) 1207 to reach a voltage level $V_{SX}$. Alternatively, the DSW control unit 1203 can take an external timing signal to determine the time interval of the $T_{DIS}$ such that DS(N) 1204 is not overlapping with the S(N) 1208. As shown in FIG. 9B, The DS(N) 1209 can be generated from the falling edge of the S(N) 1208 and the $T_{DIS}$ interval can be set as described above.

Figure 10A:
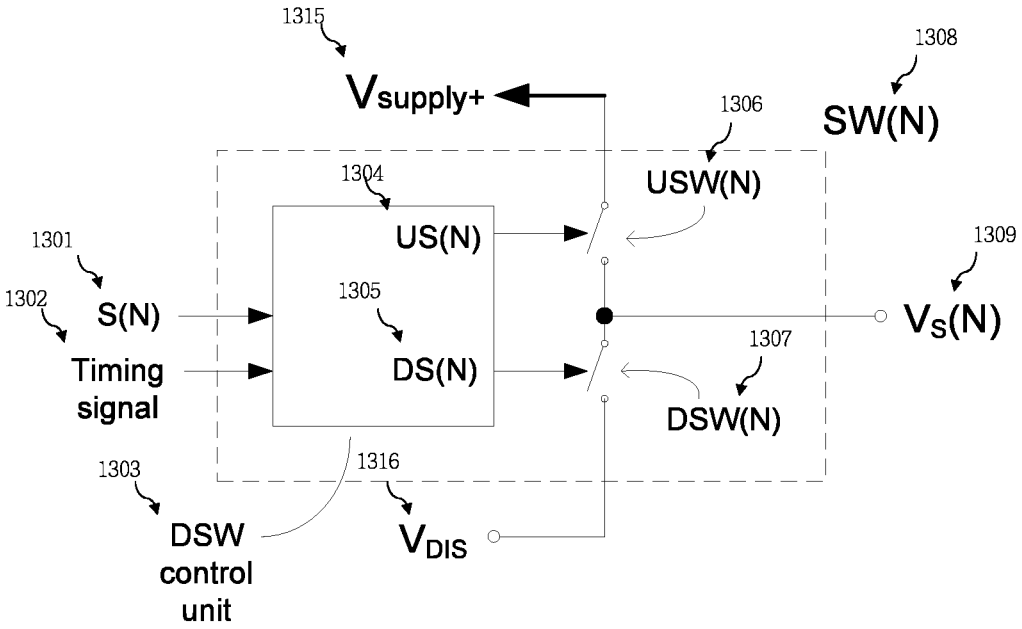
FIG. 10A-10B shows a second implementation to control the USW(s) and DSW(s).
Figure 10B:
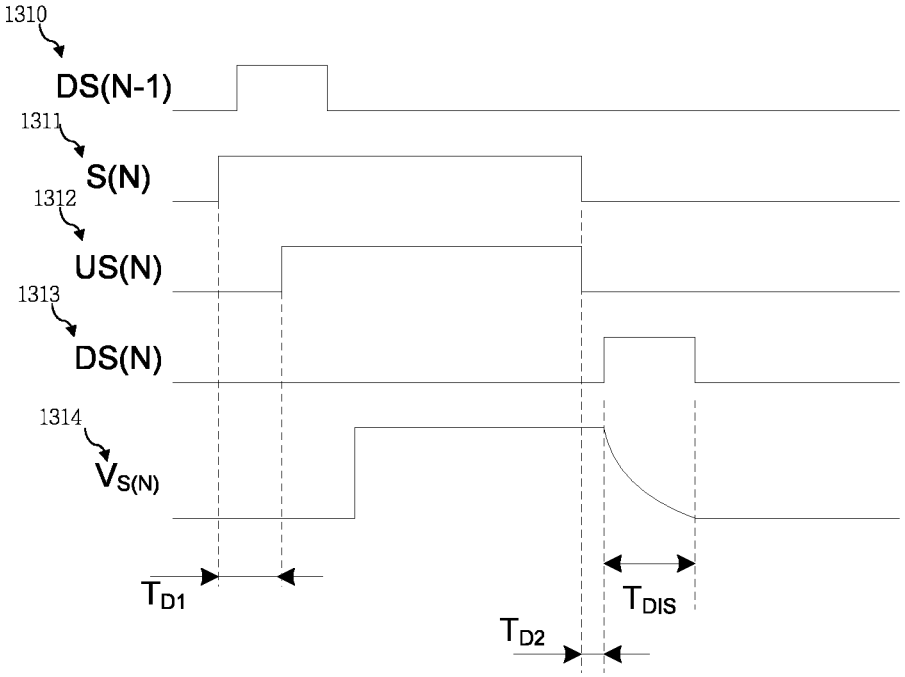

In one embodiment, as shown in FIG. 10A, the DSW control unit 1303 takes S(N) 1301 as an input and outputs US(N) 1304 and DS(N) 1305 to control the USW(N) 1306 and DSW(N) 1307, respectively. Please refer to FIG. 10B, the DSW control unit 1303 can have a delay unit to delay the rising edge of the S(N) 1301 by an interval $T_{D1}$, and then the US(N) 1304 will be set to a logic high level to turn on the USW(N) 1306. The DSW control unit 1303 can generate DS(N) 1305 for a time interval $T_{DIS}$ after delaying the falling edge of the S(N) 1301 signal by a time interval $T_{D2}$. The DSW control unit 1303 can have an internal timing control unit to set the time interval of the $T_{D1}$, $T_{D2}$, and $T_{DIS}$, respectively. The DSW control unit 1303 can also have an external timing signal to set the time interval of the $T_{D1}$, $T_{D2}$, and $T_{DIS}$ respectively.

As shown in FIG. 10A, a timing signal is inputted to the DSW control unit 1303 so that the time interval of the $T_{D1}$ and $T_{D2}$ can be set accordingly. The timing relationship between $T_{D1}$, $T_{D2}$, and $T_{DIS}$ is: $0 \leq T_{D1} \leq T_{D2}+T_{DIS}$, which means the discharging time interval in which the DS(N−1) 1310 is active can be overlapped with the on time of the US(N) 1304, which can be easily seen from FIG. 10B. The time interval $T_{D2}$ and the time interval $T_{DIS}$ can be pre-determined for discharging each scan line. When DS(N) 1313 is active, the $V_{sN}$ 1314 will begin to discharge. When $T_{D1}=0$, the US(N) 1312 signal is the same as the S(N) 1311. When $T_{D2}=0$, the DS(N) 1313 is active as soon as the US(N) 1312 becomes non-active. Please note that $T_{D1}$, $T_{D2}$ and $T_{DIS}$ can be implemented by many ways, such as an internal delay element, an internal OSC with counters or taking an external clock to implement the time intervals.

Figure 11A:
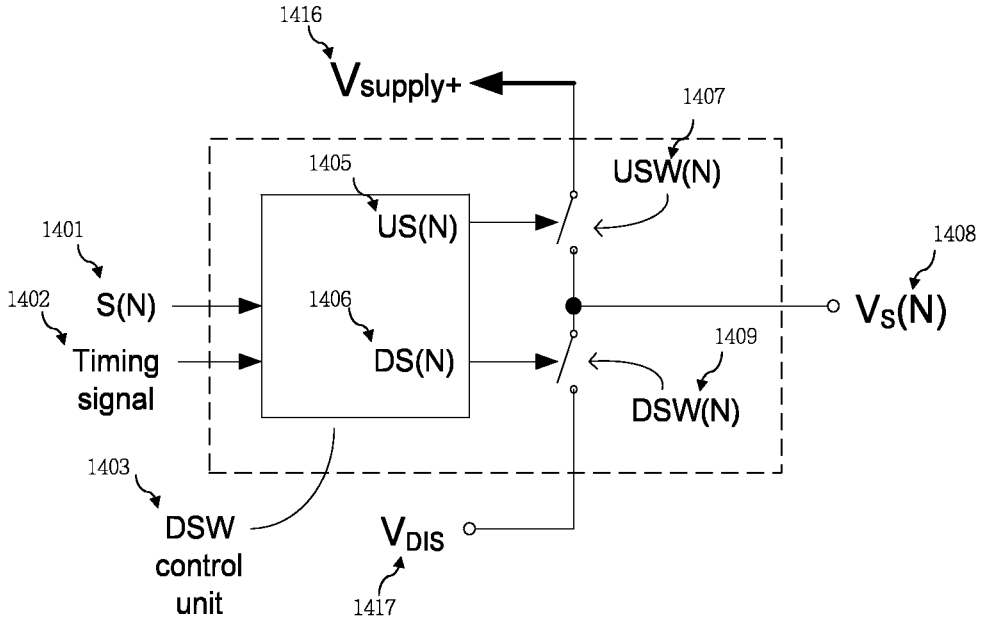
FIG. 11A-11B shows a third implementation to control the USW(s) and DSW(s).
Figure 11B:
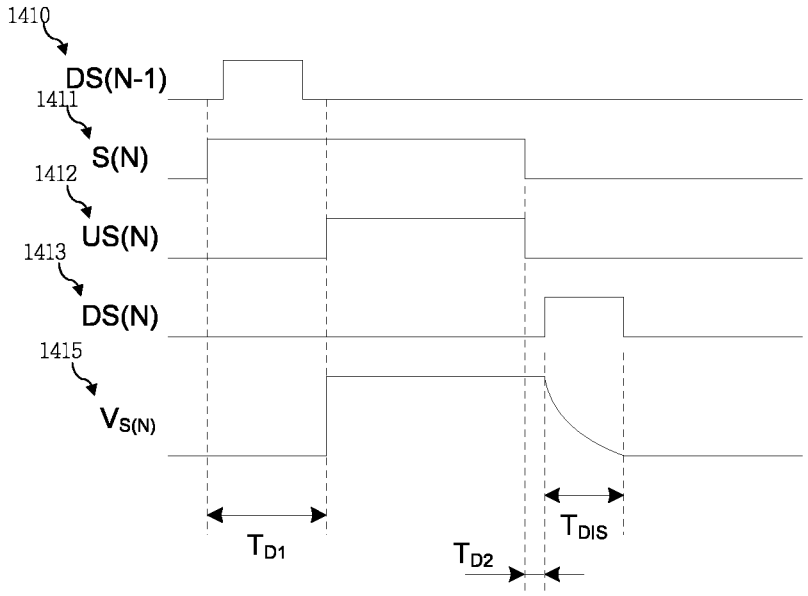

In one embodiment, as shown in FIG. 11A, the DSW control unit 1403 takes S(N) 1401 as an input and outputs US(N) 1405 and DS(N) 1406 to control the USW(N) 1407 and DSW(N) 1409, respectively. Please refer to FIG. 11B, the DSW control unit 1403 can have a delay unit to delay the positive edge of the S(N) 1401 by an interval $T_{D1}$, and after the interval TD1, the US(N) 1405 will be set to a logic high level for turning on the USW(N) 1407. The DSW control unit 1403 can also generate DS(N) 1406 control signal after delaying the falling edge of the S(N) 1401 signal by a time interval $T_{D2}$. The DSW control unit 1403 can have an internal timing control unit to set the time interval of the $T_{D1}$ and $T_{D2}$, respectively. The DSW control unit 1403 can also have an external timing signal to set the time interval of the $T_{D1}$, $T_{D2}$, and $T_{DIS}$ respectively. As shown in FIG. 11A, a timing signal is inputted to the DSW control unit 1403 so that the time interval of the $T_{D1}$ and $T_{D2}$ can be set accordingly. If $T_{D1}>T_{D2}+T_{DIS}$, DS(N−1) will not be overlapped with the US(N) 1405, which can be easily seen from FIG. 11B because the DS(N−1) will begin to discharge when the S(N) 1411 is rising, and the total time delay for discharging DS(N−1) is $T_{D2}+T_{DIS}$ as well. Please note that $T_{D1}$, $T_{D2}$ and $T_{DIS}$ can be implemented by many ways, such as an internal delay element, an internal OSC with counters or taking an external clock to implement the time intervals.

Figure 12A:
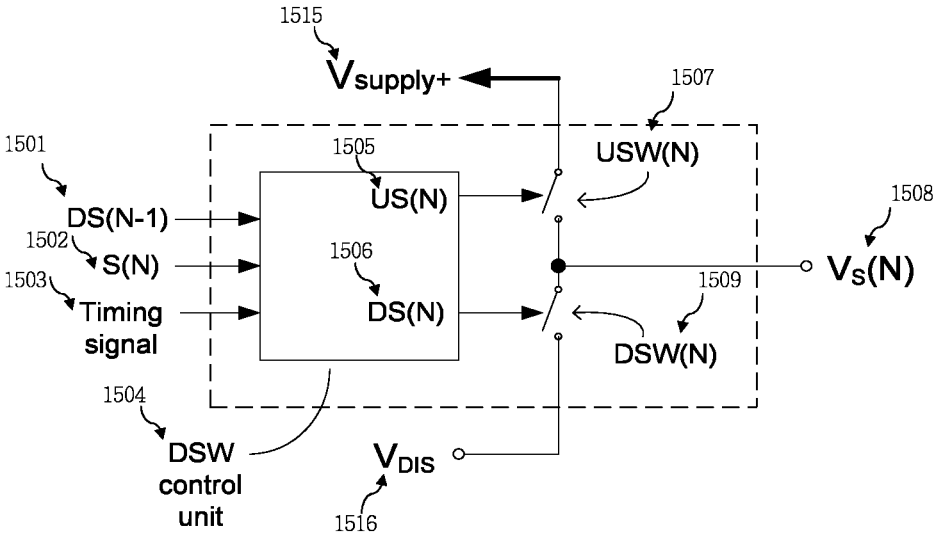
FIG. 12A-12B shows a fourth implementation to control the USW(s) and DSW(s).
Figure 12B:
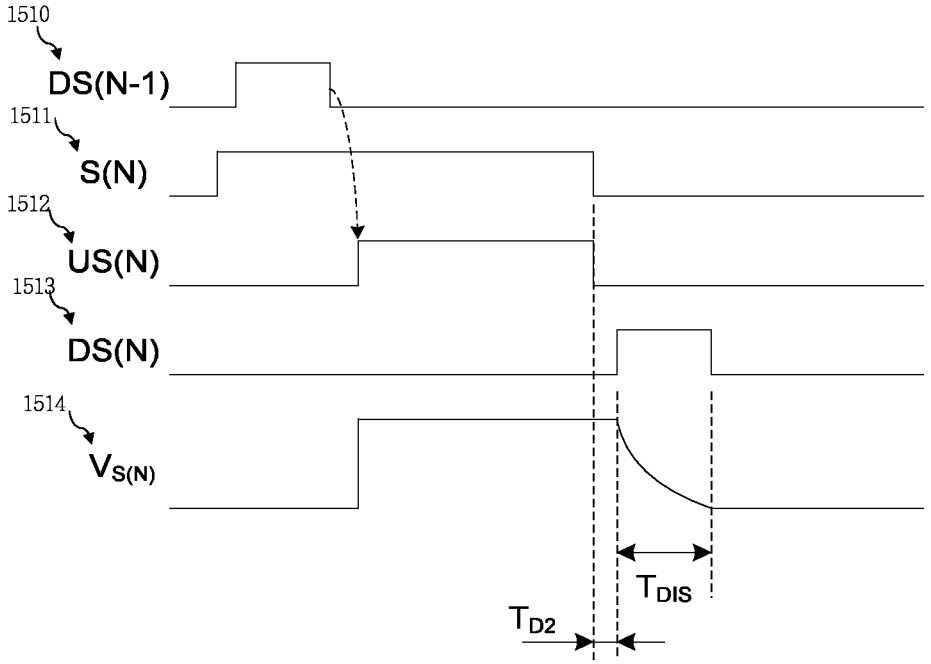

In one embodiment, as shown in FIG. 12A, the DSW control unit 1504 takes S(N) 1502, DS(N−1) 1501 as an input and outputs US(N) 1505 and DS(N) 1506, respectively. The rising edge of the US(N) 1512 can be determined by delaying the falling edge of the DS(N−1) 1510, as shown in FIG. 12B. The DSW control unit 1504 waits for a falling edge of the DS(N−1) 1510, then, force the US(N) 1512 to a logic high level. By doing so, US(N) 1512 is will not be overlapping with the DS(N−1) 1510. Other control signals will be the same as described above for FIG. 11B.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method to control charging and discharging M scan lines of an LED display, wherein each scan line(N) is electrically coupled to a corresponding USW(N) and a corresponding DSW(N), wherein each of said M and N is a nature number and 1<=N<=M, the scan line(N) represents the $N^{th}$ scan line of the LED display to be scanned, the USW(N) represents an upper switch that is electrically coupled to a first voltage reference for charging the scan line(N) when the upper switch is turned on, and the DSW(N) represents a down switch that is electrically coupled to a second voltage reference for discharging the scan line(N) when the down switch is turned on, the method comprising:

turning on the USW(N) to charge the scan line(N) for a first time interval;

turning on the DSW(N) to discharge the scan line(N) for a second pre-determined time interval;

turning off the DSW(N) after the second pre-determined time interval is elapsed; and turning on USW(N+1) to charge the scan line(N+1) for a third time interval, wherein the second pre-determined time interval is shorter than the third time interval, wherein the scan line(N+1) represents the scan line that will be scanned immediately following the scan line(N), and the USW(N+1) represents the corresponding upper switch of the scan line(N+1).

2. The method according to claim 1, wherein the second pre-determined time interval is shorter than the first time interval.

3. The method according to claim 1, wherein the third time interval is overlapped with the second pre-determined time interval.

4. The method according to claim 1, wherein the third time interval is not overlapped with the second pre-determined time interval.

5. The method according to claim 1, wherein the first reference voltage is higher than the second reference voltage, and each of the first reference voltage and the second reference voltage is higher than a ground voltage.

6. The method according to claim 5, wherein cathodes of LED(s) in each row of the LED display are biased at a third reference voltage, wherein a first voltage difference between the first reference voltage and the second reference voltage and a second voltage difference between the second reference voltage and the third reference voltage are respectively less than a forward voltage of each LED in the scan lines.

7. The method according to claim 1, wherein the first reference voltage is higher than the second reference voltage, and the second reference voltage is a ground voltage.

8. The method according to claim 1, wherein the USW(N) is turned on by a corresponding S(N) signal, wherein the DSW(N) is turned on by a corresponding DS(N) signal that is generated according to the S(N) signal, wherein said S(N) represents the enable signal to turn on the USW(N), and said DS(N) represents the enable signal to turn on the DSW(N).

9. The method according to claim 1, wherein the USW(N) is turned on by a corresponding US(N) signal and the DSW (N) is turned on by a corresponding DS(N) signal, wherein each of the US(N) signal and the DS(N) signal is generated according to a corresponding S(N) signal and a timing signal, wherein said S(N) signal represents the original enable signal to turn on the USW(N), said US(N) signal represents the actual enable signal to turn on the USW(N), and said DS(N) signal represents the enable signal to turn on the DSW(N).

10. A switch structure in an LED display having M scan lines, wherein each scan line(N) is electrically coupled to a corresponding USW(N) and a corresponding DSW(N), wherein each of said M and N is a nature number and 1<=N<=M, the scan line(N) represents the $N^{th}$ scan line of the LED display to be scanned, the USW(N) represents an upper switch that is electrically coupled to a first voltage reference for charging the scan line(N) when the upper switch is turned on, and the DSW(N) represents a down switch that is electrically coupled to a second voltage reference for discharging the scan line(N) when the down switch is turned on; and cathodes of LED(s) in each row of the LED display are biased at a third reference voltage, wherein a first voltage difference between the first reference voltage and the second reference voltage and a second voltage difference between the second reference voltage and the third reference voltage are respectively less than a forward voltage of each LED in the scan lines, wherein each USW(N) is respectively on when a corresponding US(N) signal is active; and each DSW(N) is respectively on when a corresponding DS(N) signal is active, wherein each of the DS(N) signals is active for a pre-determined time interval to discharge the scan line(N), wherein said US(N) represents the enable signal to turn on the USW (N), and said DS(N) represents the enable signal to turn on the DSW(N).

11. The switch structure according to claim 10, wherein each of the first reference voltage and the second reference voltage is higher than a ground voltage.

12. The switch structure according to claim 11, wherein the US(N) signal is active for a first time interval, and the second pre-determined time interval is shorter than the first time interval.

13. The switch structure according to claim 10, wherein any one of the DS(N) signals and any one of the US(N) signals are not active at the same time.

14. The switch structure according to claim 10, wherein each USW(N) is respectively on when a corresponding US(N) signal is active; and each DSW(N) is respectively on when a corresponding DS(N) signal is active, wherein the DS(N−1) signal and US(N) signal are active at the same time, wherein the DS(N−1) signal represents the enable signal to turn on said DSW(N−1), wherein the scan line(N−1) represents the scan line that has been scanned immediately before the scan line(N).

15. The switch structure according to claim 10, wherein the US(N) signal is derived according to a corresponding S(N) signal, and the DS(N) is generated according to the S(N) signal, wherein the S(N) represents the original enable signal to turn on the USW(N).

16. The switch structure according to claim 10, wherein each of the US(N) signal and the DS(N) signal is generated according to a corresponding S(N) signal and a timing signal, wherein said S(N) signal represents the original enable signal to turn on the USW(N).

17. The switch structure according to claim 10, wherein each of the US(N) signal and the DS(N) signal is generated according to a corresponding S(N) signal, DS(N−1) signal and a timing signal, wherein said S(N) signal represents the original enable signal to turn on the USW(N), and said DS(N−1) signal represents the enable signal to turn on the corresponding down switch of the scan line(N−1) that has been scanned immediately before the scan line(N).

18. A method to control charging and discharging M scan lines of an LED display, wherein each scan line(N) is electrically coupled to a corresponding USW(N) and a corresponding DSW(N), wherein each of said M and N is a nature number and 1<=N<=M, the scan line(N) represents the $N^{th}$ scan line of the LED display to be scanned, the USW(N) represents an upper switch that is electrically coupled to a first voltage reference for charging the scan line(N) through the upper switch when the upper switch is turned on, and the DSW(N) represents a down switch that is electrically coupled to a second voltage reference for discharging the scan line(N) through the down switch when the down switch is turned on, the method comprising:

turning on the USW(N) to charge the scan line(N) for a first time interval;

turning on the DSW(N) to discharge the scan line(N) for a second pre-determined time interval; and turning off the DSW(N) after the second pre-determined time interval is elapsed, wherein the USW(N) is turned on by a corresponding US(N) signal and the DSW(N) is turned on by a corresponding DS(N) signal, wherein each of the US(N) signal and the DS(N) signal is generated according to a corresponding S(N) signal, DS(N−1) signal and a timing signal, wherein said S(N) signal represents the original enable signal to turn on the USW (N), said US(N) signal represents the actual enable signal to turn on the USW(N), said DS(N) signal represents the enable signal to turn on the DSW(N), and said DS(N−1) signal represents the enable signal to turn on the DSW(N−1), wherein DSW(N−1) represents the corresponding down switch of the scan line(N−1), wherein the scan line(N−1) represents the scan line that has been scanned immediately before the scan line(N).

* * * * *